US005947701A

United States Patent [19]

Hugenroth

[11] Patent Number: 5,947,701

[45] Date of Patent: Sep. 7, 1999

[54] SIMPLIFIED SCROLL COMPRESSOR MODULATION CONTROL

[75] Inventor: Jason J. Hugenroth, Hope, Ark.

[73] Assignee: Scroll Technologies, Arkadelphia, Ark.

[21] Appl. No.: 09/154,370

[22] Filed: Sep. 16, 1998

[51] Int. Cl.[6] ..... F04B 49/00

[52] U.S. Cl. ..... 417/310; 417/297; 417/440

[58] Field of Search ..... 417/310, 297, 417/440

[56] References Cited

U.S. PATENT DOCUMENTS 5,362,211 11/1994 Iizuka ..... 417/310
5,577,897 11/1996 Inagaki ..... 417/310
5,678,985 10/1997 Brooke ..... 417/299

*Primary Examiner*—Timothy S. Thorpe
*Assistant Examiner*—Ehud Gartenberg
*Attorney, Agent, or Firm*—Howard & Howard

[57] ABSTRACT

Simplified capacity control mechanisms for scroll compressors include a fork operable to open and close vents associated with a pair of scroll compression chambers. A single fork opens and closes both vents simultaneously. In the past, separate members have been utilized to open and close the two individual valves, and they have sometimes been actuated in a non-synchronous manner. A control associated With the fork is operable to move the fork between the open and closed positions by simple electronic controls. In several embodiments, the electronic controls are operated simply to stop and start the electric motor for driving the compressor. Pressure forces on and associated valve element move the fork to the desired position between the open and closed positions. No separate control wires, or separate electronic valves, need to pass into the scroll housing. In another embodiment, an electric solenoid is actuated to move the fork between open and closed positions.

20 Claims, 5 Drawing Sheets

Fig-6
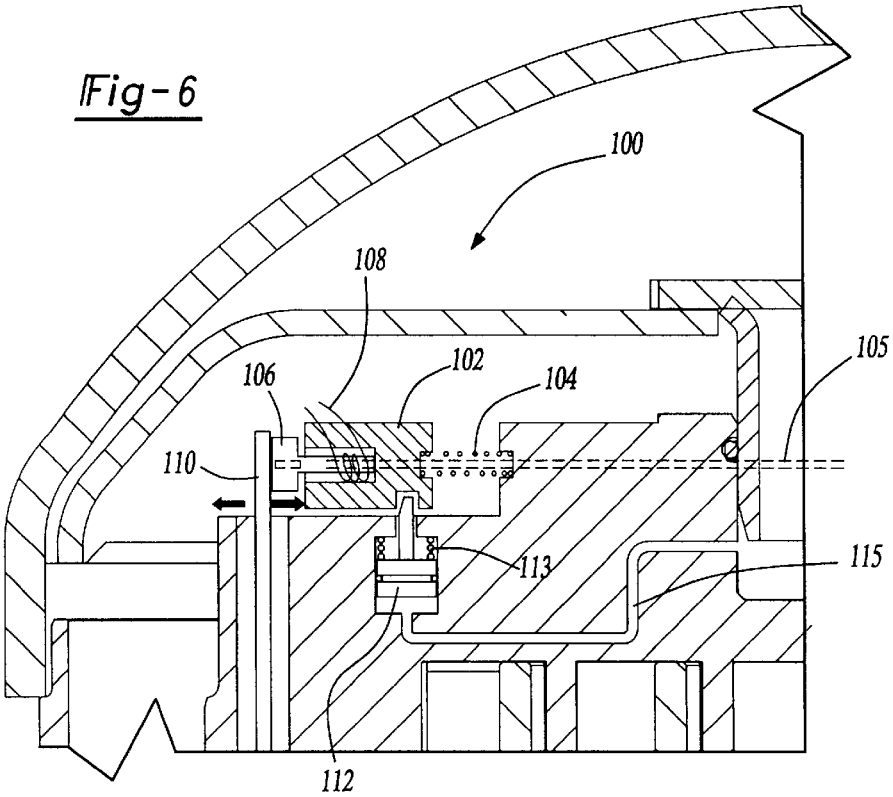
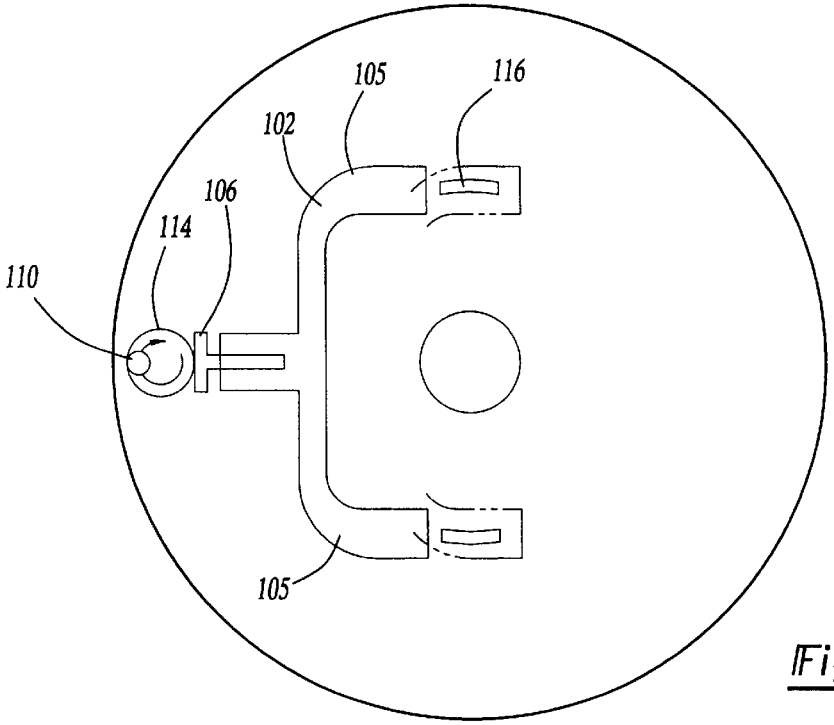
Fig-7

SIMPLIFIED SCROLL COMPRESSOR MODULATION CONTROL

BACKGROUND OF THE INVENTION

This application relates to improvements in capacity control systems for scroll compressors.

Modern compression applications often utilize scroll compressors. Scroll compressors comprise an orbiting scroll which has a base and a generally spiral wrap extending from the base. A non-orbiting scroll also includes a base and a generally spiral wrap which interfits with the spiral wrap of the orbiting scroll. A number of compression chambers are formed between the two wraps. The orbiting scroll is driven by an electric motor to orbit relative to the non-orbiting scroll, the volume of the chambers is reduced, and an entrapped fluid is compressed. There are usually a pair of associated chambers being compressed towards a discharge port.

In some applications, it is desirable to reduce the compressed fluid volume. In the prior art, vent ports have typically been formed through the base of the non-orbiting scroll, with a port associated with each of the pair of scroll chambers. Thus, there have typically been at least two vent ports for allowing fluid to flow out of the compression chambers.

In the prior art, complex valving structures are incorporated to open and close the ports. Further, there has typically been separate valves associated with the two vents. Also, the prior art has typically utilized electronic valves associated with each of the ports.

The use of the two separate valves is somewhat undesirable in that the actuation has not always been synchronized. This may result in unwanted noise, vibration, etc. Further, the use of the separate electrical valves increases the cost and complexity of the scroll compressor.

SUMMARY OF THE INVENTION

In a disclosed embodiment of this invention, a scroll compressor includes a volume control actuated to move between a full and a reduced volume position simply by turning on and off the electric drive motor. In one embodiment, a valve associated with the vent ports is locked at a reduced volume position by a lock member. However, if the scroll compressor motor is stopped for a short period of time, the lock is released and the valve moves to a full capacity position. A control shuts the motor down for a short period of time and then restarts the motor. At that time, the valve is at the full capacity position. Otherwise, the compressor is locked at a reduced capacity position. The control is programmed to be operable to start up within the short period of time. The short period of time is defined by system parameters such that the lock will be at its open position.

Due to the simple control, no complex wires need pass into the scroll compressor housing. Instead, the motor control wires which already pass into the housing may be utilized to achieve the capacity control.

The lock is operable in this way because it is biased to a locking position. The bias is opposed by a first pressure force from downstream of the discharge check valve. A second pressure force from upstream of the discharge pressure check valve opposes the first force. When the compressor is running, or if the compressor has been shut down for a relatively long period of time, the two discharge pressures are effectively equal. Thus, the bias force of the spring causes the lock to remain at the locked position. On the other hand, shortly after the compressor is stopped, the pressure upstream of the check valve approximates the suction pressure while the pressure downstream of the check valve is high. At that time, the lock is moved to the open position and the volume control valve is moved to the full capacity position.

In a second embodiment, very similar to the first embodiment, a second check valve is placed on a second chamber which communicates with the chamber upstream of the discharge check valve. The second chamber remains at the pressure downstream of the discharge check valve for a short period of time after shutdown. Thus, this embodiment will work similar to the first embodiment.

In a third embodiment similar to the first embodiment, a valve is provided with taps to the two pressure forces upstream and downstream of the discharge check valve. The valve is moveable upon stopping of the compressor to actuate a ball-point pen actuator. The ball-point pen actuator moves the volume control between the full and reduced capacity positions. Thus, the control merely alternatively stops and starts the motor to result in the desired capacity. There are three sub-embodiments of this basic concept disclosed.

In another embodiment, rather than stopping and starting a motor, a solenoid is actuated to move an abutment member against a synchronizer. The synchronizer contacts the abutment member and moves the valve member to the reduced capacity position. A lock similar to the above embodiments locks the valve at the reduced position. When the motor is stopped, the valve returns to the full capacity position.

With all of the above-disclosed embodiments, it is preferred that an actuator fork is utilized which includes surfaces which cover both vents associated with the two chambers. In this way, the present invention ensures that the valves are opened and closed in a synchronous fashion.

These and other features of the present invention can best be understood from the following specification and drawings, the following of which is a brief description.

BRIEF DESCRIPTION OF THE DRAWINGS

FIG. 6 shows a fourth embodiment scroll compressor.

FIG. 7 is a top view of the embodiment shown in FIG. 6.

DETAILED DESCRIPTION OF PREFERRED EMBODIMENTS

Figure 1:
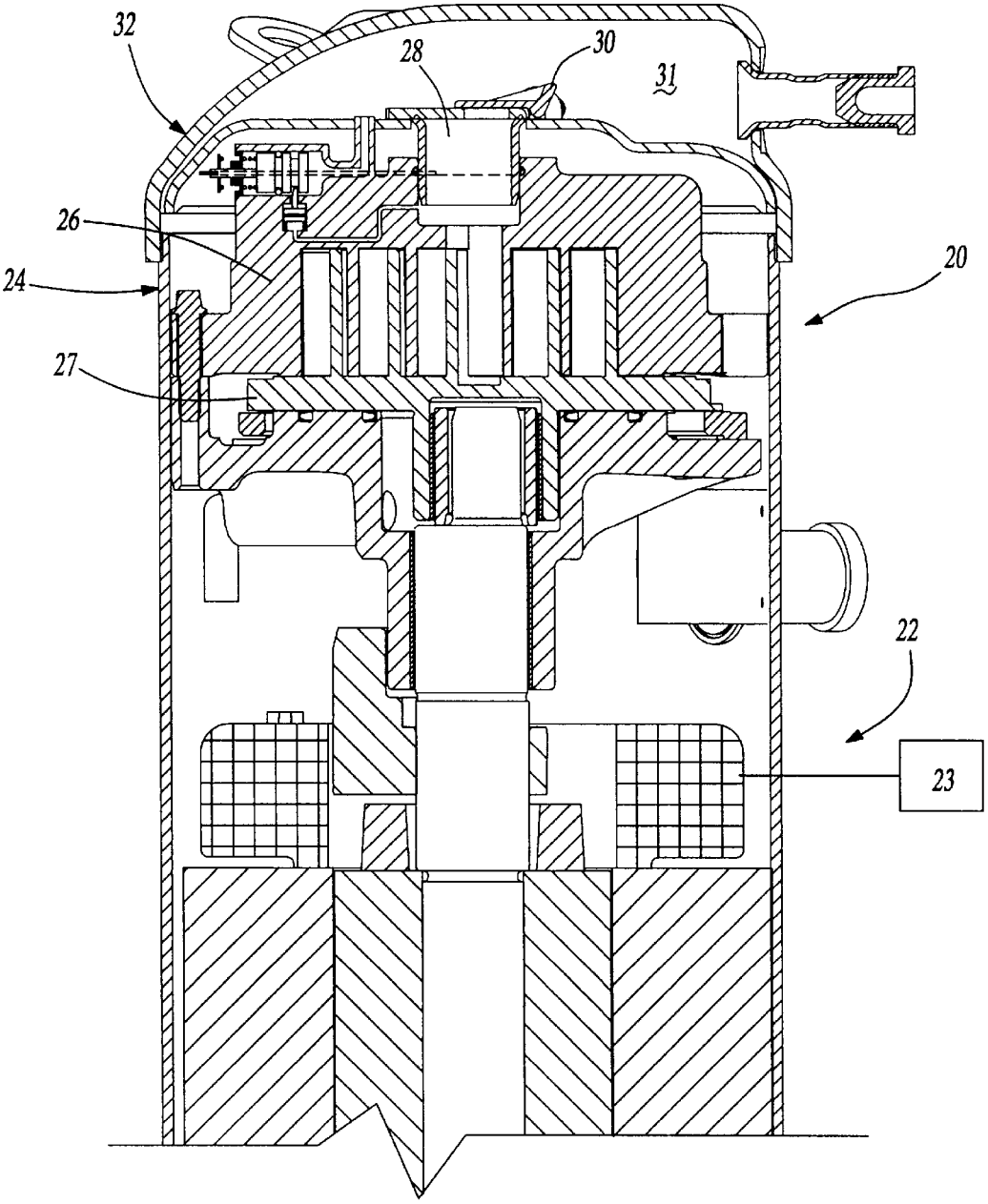
FIG. 1 is a cross-sectional view of a first embodiment scroll compressor.

A first embodiment scroll compressor 20 is illustrated in FIG. 1 including a motor 22, motor control 23, and a pump unit 24, as known. A non-orbiting scroll 26 and an orbiting scroll 27 are provided with a base and a generally spiral wrap. The wraps of the two scroll members interfit to define compression chambers. Typically, there are two compression chambers being compressed and driven towards a discharge chamber 28 at any one time. A discharge check valve 30 is positioned downstream of chamber 28. A discharge pressure plenum 31 is formed downstream of the check valve 30.

A valve volume control 32 is operable to open and close portions of the compression chambers to allow compressor 20 to be operated at full or reduced capacity. It is volume control 32, and other embodiments which are the inventive aspect of this embodiment.

Figure 2:
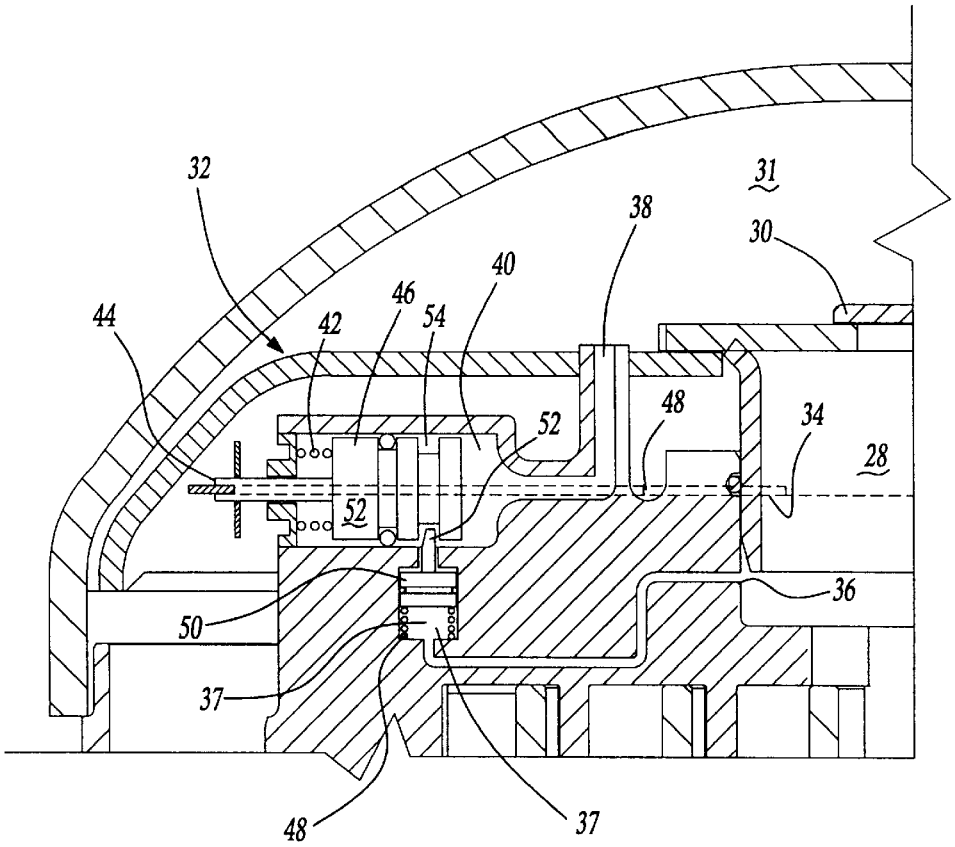
FIG. 2 is an enlarged view of a portion of the FIG. 1 scroll compressor.

As shown in FIG. 2, the valve control 32 has a tap 36 leading to a chamber 37 and from chamber 28. Another tap 38 leads from plenum 31 to chamber 40. A spring 42 biases a volume control 44 and a valve 46 to the right, and to the position illustrated in FIG. 2. A spring 48 drives a valve lock member 50 having a pin 52 into a groove 54 in valve 46. Thus, the valve 46 is locked at the position of FIG. 2.

Figure 3:
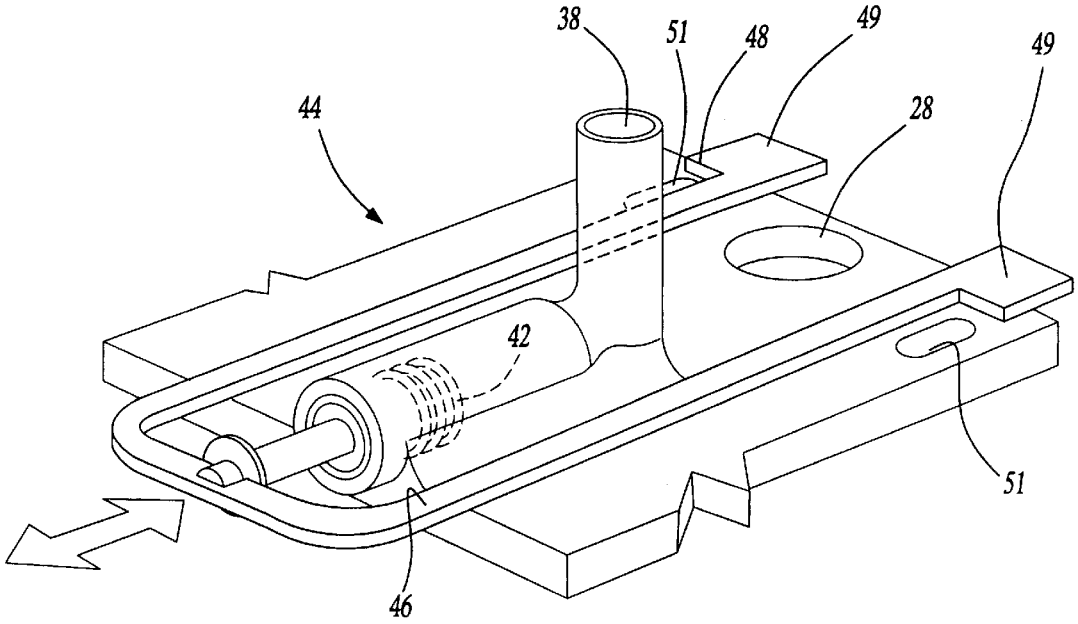
FIG. 3 is a view of a portion of the scroll compressor shown in FIG. 2.

As shown in FIG. 3, volume control 44 forms an actuator fork 248 having surfaces 49 which open and close vent ports 51. As explained above, vent ports 51 extend through the fixed scroll member 26, and into the two scroll compressor chambers.

When the compressor is operated normally, spring 42 drives valve 46 to the position illustrated in FIGS. 2 and 3. Pin 52 locks valve 46 at this position. Vents 51 are open, and the compressor operates at reduced capacity. In this position, the pressure from plenum 31 is tapped into chamber 40. The top of valve 50 is exposed to this pressure. At the same time, pressure from chamber 28 is tapped to the bottom of valve 50. The pressure in chambers 28 and 31 are effectively equal while the compressor is operating. The same is true once the compressor has been stopped for a relatively long period of time. Thus, the valve 50 is maintained in a locked position, if in the locked position when the compressor is started.

Soon after the compressor is stopped, the pressure in chamber 31 exceeds the pressure in chamber 28. Valve 30 is closed. The pressure in chamber 28 quickly approximates the suction pressure, while the pressure downstream of valve 30 in chamber 31 remains high. Thus, for a short period of time after shutdown of the compressor, the force on top of valve 50 is greater than the force below valve 50. The valve 50 then moves downwardly to an unlocked position. At that time, since the force in chamber 40 is high compared to the force of the spring 42, the valve 46 is driven to the left from the position shown in FIG. 2. At that time, the surfaces 49 cover the vents 51. During continued operation, the high pressure in chamber 40 keeps valve 46 to this full capacity position.

Once the compressor has been shut down for a relatively long period of time, the pressure in chamber 31 approximates the pressure in chamber 28; valve 46 returns to the right and locking valve 50 returns to its locked position.

Since valve 46 will be in the full capacity position, with surfaces 49 covering vents 51, for a short period of time after shutdown, control 23 may be utilized to stop and start the motor to move the valve 46 to a desired position between full and reduced capacity. The control 23 is programmed to stop and then start the motor after a very short period of time, to achieve full capacity. The short period of time is determined to allow sufficient time for the valve 50 to move to its unlocked position, and valve 46 to move to the full capacity position, but still to be short enough such that the pressure in chamber 31 remains high compared to the pressure in chamber 28.

When it is desired to operate the compressor under reduced capacity, it is simply started and allowed to run. However, once it is desired to increase to full capacity, the motor is stopped by control 23. The motor is then restarted after a short period of time and the valve 46 is held at the full capacity position.

Figure 4:
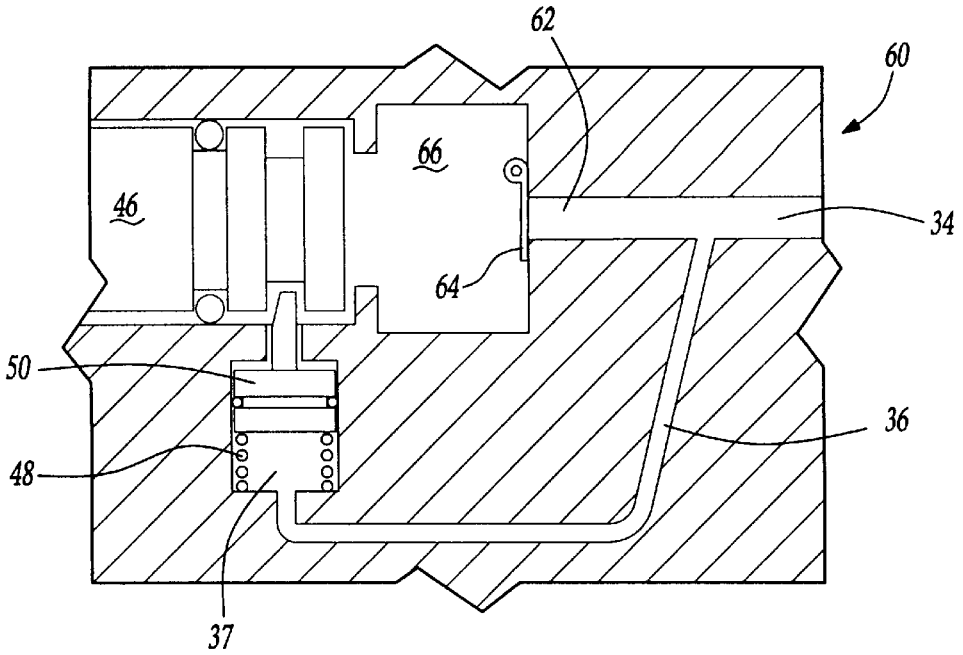
FIG. 4 shows a second embodiment scroll compressor.

FIG. 4 shows an embodiment 60 which is very similar to the first a tap 62 from chamber 28 leads through a valve 64 to a separate chamber 66, which is similar to chamber 40. A short period of time after shutdown, the chamber 66 will be at a pressure higher than that in chamber 28 due to the check valve 64. This will again cause the valve 46 to move against its spring force and provide full capacity. The control for this system operates the same as discussed above.

Figure 5:
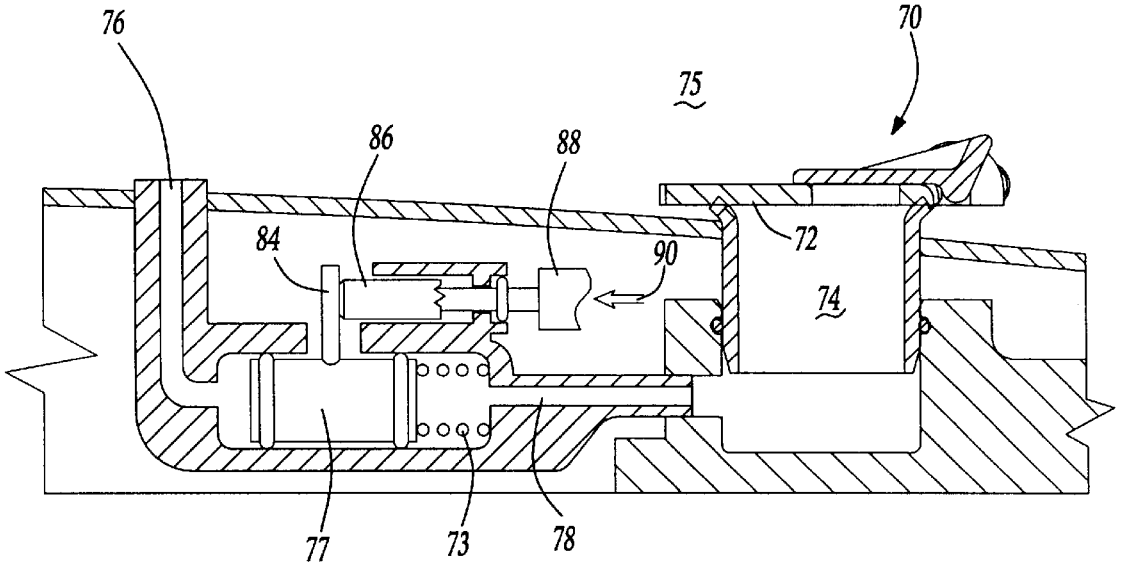
FIG. 5 shows a third embodiment scroll compressor.

A third embodiment 70 is illustrated in FIG. 5. The discharge check valve 72 defines a chamber 74 upstream of the check valve and another chamber 75 downstream of the check valve. A tap 76 from chamber 75 leads to one face of a piston 77 and another tap 78 leads from chamber 74 to an opposed face. A stop 84 operates to actuate a ball-point pen type actuator 86. Ball-point pen actuator may be similar to known actuators utilized to actuate a ball-point pen. Upon each actuation a member driven by the actuator, here actuator fork 88 is driven between two positions. Although not shown fork 88 has the structure to close off two ports as with the above embodiments. A spring 90, shown schematically, biases the fork 88 back to the left. As with the prior embodiments, a short period of time after stopping, the piston 77 will be driven to the right against the spring force of spring 73 due to the force imbalance between chambers 74 and 75. This will cause stop 84 to contact and actuate the actuator 86. Each actuation of the actuator 86 drives the actuator fork 88 between the full and reduced capacity positions. By controlling the number of actuations, the control achieves the desired capacity state.

FIG. 6 shows yet another embodiment 100 wherein the actuator fork 102 is biased by a spring 104 to move the sealing surfaces 105 between the full and reduced capacity positions. A separate stop 106 is actuated by a solenoid 108 (shown schematically) to move to the left and right relative to the fork 102. When driven outwardly by actuation of the solenoid, the stop 106 contacts synchronizer 110 which orbits with the orbiting scroll. The synchronizer 110 may orbit with the orbiting scroll, or with the Oldham coupling, which is utilized to guide the orbiting scroll for orbital movement.

When the synchronizer 110 contacts stop 106, it moves the fork 102 to the full capacity position shown in FIG. 6. As shown, a lock 112, having a spring 113, locks the valve in the full capacity position. Lock 112 is distinct from the previously disclosed locks in that the spring biases the lock to the non-locked position. Further, the top of the lock is exposed to suction pressure, rather than discharge pressure. Now, if the solenoid has been actuated and the actuator fork 102 moved to the full capacity position, the tap 115 taps discharge pressure to the bottom of the lock 112. The spring force 113 will be overcome, since in opposition to the discharge pressure force there is only suction pressure. The fork 102 thus remains in a locked position. Once the compressor is shut down, the pressure in the suction chamber equalizes the pressure in the discharge chamber and the spring 104 can return the fork to the reduced capacity position. Thus, by stopping and starting the motor, and actuating solenoid 108, a desired state is achieved.

As shown in FIG. 7, the synchronizer 110 includes a member 114 such that the synchronizer 110 has an eccentric orbit to contact stop 106. As also shown, the surfaces 105 selectively close vents 116.

Figure 8:
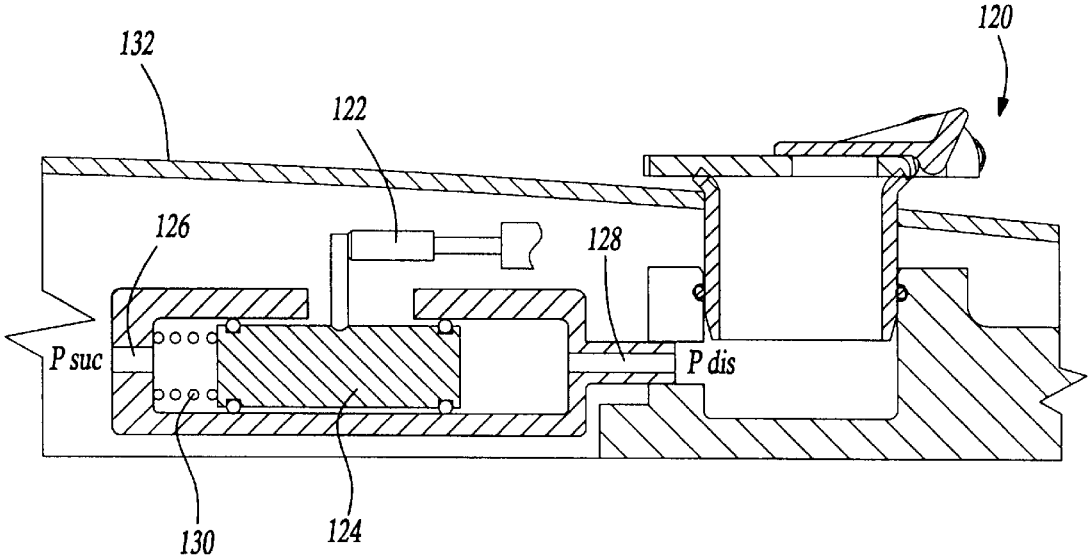
FIG. 8 shows a fifth embodiment which is similar to the FIG. 5 embodiment.

FIG. 8 shows an embodiment 120 which operates somewhat similar to the FIG. 5 embodiment in that a ball-point pen actuator 122 is utilized. With this embodiment, the valve 124 sees suction pressure 126 at one end and discharge pressure upstream of the check valve at the opposed end 128. A spring 130 biases the valve 124 against the ball-point pen mechanism. Each time the compressor shuts down, the pressure at 126 will equalize with the pressure at 128, and the spring 130 will drive the valve 124 to actuate the ball-point pen mechanism 122.

This arrangement may be somewhat less complex to incorporate then the embodiment shown in FIG. 5, since with this embodiment one need not perforate the separator plate 132.

Figure 9:
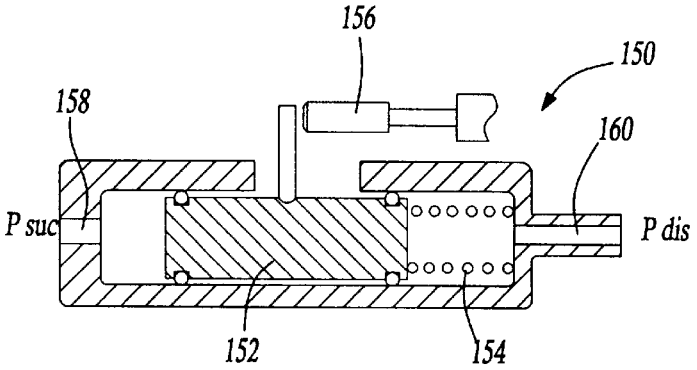
FIG. 9 shows a sixth embodiment which is similar to the FIG. 5 and FIG. 8 embodiments.

FIG. 9 shows an embodiment 150 wherein the valve 152 is spring-biased 154 away from a ball-point pen actuator 156. Again, suction pressure 158 and pressure 160 upstream of a check valve bias the valve 152. To control this embodiment, the compressor motor will be momentarily ran in reverse to cause the suction pressure 158 to be greater than the upstream discharge pressure 160. This will cause the actuator valve to actuate the ball-point pen mechanism.

Thus, this compressor is switched between full and modulated operation whenever the motor causes the compressor to run in reverse for a short period of time. All other times, the ball-point pen actuator remains in its current state.

Several preferred embodiments have been disclosed. A worker of ordinary skill in this art would recognize that modifications of these embodiments would come within the scope of this invention. For that reason, the following claims should be studied to determine the true scope and content of this invention.

What is claimed is:

1. A scroll compressor comprising:

a first scroll member having a generally spiral wrap extending from a base, and a second scroll member having a generally spiral wrap extending from a base, said first scroll member being driven for orbital movement relative to said second scroll member, and said wraps of said first and second scroll members interfitting to define compression chambers.

an electric motor for driving said first scroll member to orbit relative to said second scroll member;

a control for stopping and starting said electric motor; and a capacity valve for controlling a capacity of refrigerant compressed in said compression chambers, said capacity valve modifying a volume of refrigerant which is compressed upon stopping and starting said motor.

2. A scroll compressor as recited in claim 1, wherein said capacity valve is actuated by stopping said motor for less than a predetermined period of time.

3. A scroll compressor as recited in claim 1, wherein said capacity valve is biased and locked at an open position once said predetermined period of time is exceeded, such that when said motor is started after a shutdown time exceeding said predetermined time, said compressor will be started at a reduced capacity operation.

4. A scroll compressor as recited in claim 3, wherein said lock includes a member biased on one face by a discharge pressure upstream of a discharge check valve, and on a second face by a discharge pressure downstream of said discharge check valve such that upon a short period of time after shutdown, said discharge pressure downstream of said check valve exceeds said discharge pressure upstream of said check valve and said lock is moved to release said valve and that upon a short shutdown, said capacity valve is operable to move to a full capacity position, such that upon actuating said control to shut said motor down for a short period of time and then to restart it, the compressor achieves full capacity.

5. A scroll compressor as recited in claim 1, wherein a ball-point pen actuator is utilized such that each time said motor is stopped and restarted, said capacity valve moves between full and reduced capacity, and said control stops and starts said motor to achieve a desired capacity level.

6. A scroll compressor as recited in claim 5, wherein said capacity valve includes a piston biased to actuate said ball-point pen actuator upon stopping and starting of said motor.

7. A scroll compressor as recited in claim 6, wherein said piston has a first face exposed to a discharge pressure upstream of a discharge check valve and a second face exposed to a discharge pressure downstream of said check valve such that said piston is moved a short time after shutdown of said compressor.

8. A scroll compressor as recited in claim 1, wherein said capacity valve is moved in opposed directions under the control of a solenoid, and the control of said electric motor.

9. A scroll compressor comprising:

a first scroll member having a generally spiral wrap extending from a base, and a second scroll member having a generally spiral wrap extending from a base, said first scroll member being driven for orbital movement relative to said second scroll member, and said wraps of said first and second scroll members interfitting to define at least a pair of compression chambers moved towards a discharge port together;

a pair of vents passing through the base of one of said control members and communicating with respective ones of said compression chambers;

a capacity valve for controlling a capacity of refrigerant compressed in said compression chambers, said capacity valve being actuatable to modify a volume of refrigerant which is compressed, said capacity valve including a fork member, and said fork being operable to close off both of said vents at the same time, said fork having two surfaces which close off said pair of vents, and there being an actuation structure for moving said fork between open and closed positions.

10. A scroll compressor as recited in claim 9, wherein said fork is moved by stopping and starting a motor.

11. A scroll compressor as recited in claim 10, wherein a lock locks said fork at least in one of said open and closed positions.

12. A scroll compressor as recited in claim 11, wherein said lock includes a member which is biased on one face by a discharge pressure upstream of a discharge check valve, and on a second face by a discharge pressure downstream of said discharge check valve such that upon a short period of time after shutdown, said discharge pressure downstream of said check valve exceeds said discharge pressure upstream of said check valve and said lock is moved to release said valve and that upon a short shutdown, said capacity valve is operable to move to said closed position, such that upon actuating a motor control to shut said motor down for a short period of time and then to restart it, the compressor achieves full capacity.

13. A scroll compressor as recited in claim 11, wherein a ball-point pen actuator is utilized such that each time said motor is stopped and restarted, said capacity valve moves between said open and closed positions, and said control stops and starts said motor to achieve a desired capacity level.

14. A scroll compressor as recited in claim 13, wherein said control includes a piston biased to actuate said ball-point pen actuator upon stopping and starting of said motor.

15. A scroll compressor as recited in claim 14, wherein said piston has a first face exposed to a discharge pressure upstream of a discharge check valve and a second face exposed to a discharge pressure downstream of said check valve such that said piston is moved a short time after shutdown of said compressor.

16. A scroll compressor as recited in claim 10, wherein said fork is actuated by a solenoid control.

17. A scroll compressor as recited in claim 15, wherein a synchronizer moves with an orbiting component which orbits with said first scroll member, said synchronizer being operable to move said fork to at least one of said open and closed positions.

18. A scroll compressor as recited in claim 17, wherein said synchronizer is fixed to orbit with said first scroll.

19. A scroll compressor as recited in claim 18, wherein a lock locks said fork in at least one of said open and closed positions.

20. A scroll compressor as recited in claim 19, wherein said lock locks said fork at said closed position.

* * * * *